US011346148B1

(12) United States Patent
Mazur et al.

(10) Patent No.: US 11,346,148 B1
(45) Date of Patent: May 31, 2022

(54) SHEAR PLATE FOR WINDOW FRAME ASSEMBLY

(71) Applicant: WWS Acquisition, LLC, Phoenix, AZ (US)

(72) Inventors: Richard Mazur, Mesa, AZ (US); Jennifer Lloyd-Randolfi, Chandler, AZ (US); Dustin Wright, Phoenix, AZ (US); Jacob Blackburn, Phoenix, AZ (US)

(73) Assignee: WWS Acquisition, LLC, Phoenix, AZ (US)

( * ) Notice: Subject to any disclaimer, the term of this patent is extended or adjusted under 35 U.S.C. 154(b) by 0 days.

(21) Appl. No.: 16/748,686

(22) Filed: Jan. 21, 2020

Related U.S. Application Data

(60) Provisional application No. 62/798,825, filed on Jan. 30, 2019.

(51) Int. Cl.
*E06B 3/263* (2006.01)
*E06B 3/36* (2006.01)

(52) U.S. Cl.
CPC ..... *E06B 3/2632* (2013.01); *E06B 3/36* (2013.01); *E06B 2003/2639* (2013.01); *E06B 2003/26361* (2013.01)

(58) Field of Classification Search
CPC ..... E06B 3/263; E06B 3/2632; E06B 3/36; E06B 3/26301; E06B 3/26303;
(Continued)

(56) References Cited

U.S. PATENT DOCUMENTS 4,295,638 A * 10/1981 Eldeen ..... E04F 11/025 256/59
4,495,726 A * 1/1985 Lindstrom ..... E06B 3/26301 49/401
(Continued)

FOREIGN PATENT DOCUMENTS

CA 3035103 A1 * 5/2019 ..... E06B 3/26303
DE 202012003730 U1 * 6/2012 ..... E06B 3/26303
(Continued)

OTHER PUBLICATIONS

Cutting Tool Engineering, The Hole Edge, Mar. 1, 2011, p. 13 (https://www.ctemag.com/news/articles/hole-edge).*
(Continued)

*Primary Examiner* — Christine T Cajilig
(74) *Attorney, Agent, or Firm* — Taylor English Duma LLP

(57) ABSTRACT

Example aspects of a shear plate for a window frame assembly, a window frame assembly, and a method for insulating a window frame assembly are disclosed. The shear plate for a window frame assembly can comprise a shear plate body defining an outer shear plate surface and an inner shear plate surface, the shear plate body defining a first end, a second end opposite the first end, and a pair of lateral sides extending between the first end and the second end; and at least one pair of shear plate holes extending from the outer shear plate surface to the inner shear plate surface, the pair of shear plate holes oriented such that a line running through a center of the pair of shear plate holes is substantially parallel to the first end and the second end.

19 Claims, 4 Drawing Sheets

(58) Field of Classification Search
CPC ..... E06B 3/273; E06B 2003/26361; E06B 2003/2639; E06B 2003/2637; E06B 2003/26387
See application file for complete search history.

(56) References Cited

U.S. PATENT DOCUMENTS

| | | | | |
|---|---|---|---|---|
| 6,290,212 | B1 * | 9/2001 | Bartel | E04F 11/181 256/59 |
| 7,125,002 | B2 * | 10/2006 | Platt | E04H 17/1417 256/65.04 |
| D834,219 | S * | 11/2018 | Pilja | D25/133 |
| 10,202,797 | B1 * | 2/2019 | Header | E06B 3/26 |
| 2003/0197145 | A1 * | 10/2003 | Fortino | F16K 27/07 251/291 |
| 2004/0017087 | A1 * | 1/2004 | Ayres | E05B 9/02 292/165 |
| 2005/0216008 | A1 * | 9/2005 | Zwirnmann | A61B 17/8085 606/281 |
| 2007/0154258 | A1 * | 7/2007 | Knapp | F16B 12/20 403/331 |
| 2014/0260064 | A1 * | 9/2014 | Hensley | E06B 3/26301 52/656.9 |
| 2019/0211543 | A1 * | 7/2019 | Abernathy | E04B 1/2403 |
| 2020/0355002 | A1 * | 11/2020 | Kohl | E05D 3/08 |

FOREIGN PATENT DOCUMENTS

| | | | | |
|---|---|---|---|---|
| DE | 102016114668 | B3 * | 12/2017 | E06B 3/26303 |
| EP | 1182317 | A2 * | 2/2002 | E06B 3/26303 |
| EP | 2116685 | A2 * | 11/2009 | E06B 3/26303 |
| EP | 3447229 | A1 * | 2/2019 | E06B 3/26301 |
| FR | 3067740 | A1 * | 12/2018 | E06B 3/26301 |

OTHER PUBLICATIONS

Bulldog 37mm Offset Plate, Nov. 2, 2019 (https://web.archive.org/web/20191102132856/http://www.bulldogtools.com:80/prosthetic/37-mm-offset-plate-aluminum_p_4848.html) ).*
Wikipedia, Countersink, p. 2 (https://en.wikipedia.org/wiki/Countersink). Aug. 3, 2021.*

* cited by examiner

SHEAR PLATE FOR WINDOW FRAME ASSEMBLY

CROSS-REFERENCE TO RELATED APPLICATIONS

The present application claims priority to U.S. Provisional Application No. 62/798,825, filed Jan. 30, 2019, which is hereby specifically incorporated by reference herein in its entirety.

TECHNICAL FIELD

This disclosure relates to window frames. More specifically, this disclosure relates to a shear plate for a window frame assembly.

BACKGROUND

Window frames, which can include sliding and hinged glass doors, can comprise a thermal break to prevent heat transfer between an exterior frame member and an interior frame member of the frame. The thermal break can be a thermal insulator such as plastic, and the exterior and interior frame members can be a thermally conductive material such as aluminum, steel, or other metals. Under high wind loads, the thermal break can shift or break, and thus be a weak link in the frame structure.

SUMMARY

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts off the disclosure as an introduction to the following complete and extensive detailed description.

Disclosed is a shear plate for a window frame assembly comprising a shear plate body defining an outer shear plate surface and an inner shear plate surface, the shear plate body defining a first end, a second end opposite the first end, and a pair of lateral sides extending between the first end and the second end; and at least one pair of shear plate holes extending from the outer shear plate surface to the inner shear plate surface, the pair of shear plate holes oriented such that a line running through a center of the pair of shear plate holes is substantially parallel to the first end and the second end.

Also disclosed is a window frame assembly comprising a window frame; a thermal break engaging the window frame, the thermal break defining a recess; and a shear plate mounted in the recess and fastened to the window frame.

A method for insulating a window frame assembly is also disclosed, the method comprising providing a window frame comprising an exterior frame member and an interior frame member; mounting a shear plate in a recess of a thermal break; engaging the thermal break with the exterior frame member and the interior frame member; and fastening the shear plate to the exterior frame member and the interior frame member.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Figure 1:
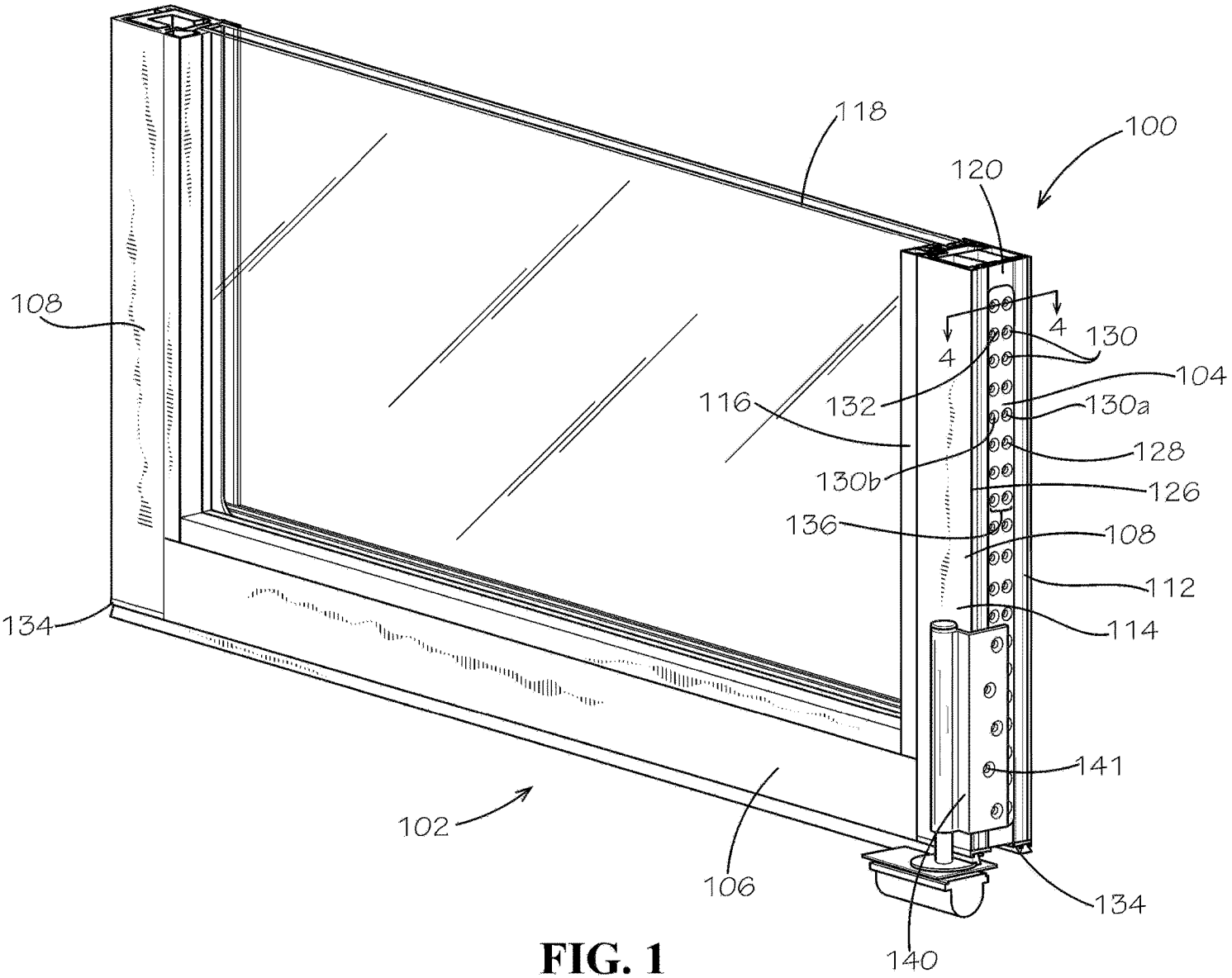
FIG. 1 is a perspective view of a window frame assembly comprising a shear plate.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed is a shear plate for a window frame assembly and associated methods, systems, devices, and various apparatus. Example aspects of the shear plate can comprise a shear plate body and one or more shear plate holes formed through the shear plate body. It would be understood by one of skill in the art that the disclosed shear plate is described in but a few exemplary embodiments among many. No particular terminology or description should be considered limiting on the disclosure or the scope of any claims issuing therefrom.

For ease of understanding, the use of the directional terms herein, such as right, left, front, back, top, bottom, and the like can refer to the orientation shown and described in the corresponding figures, but these directional terms should not be considered limiting on the orientation or configuration required by the present disclosure. Further, the use of ordinal terms herein, such as first, second, third, fourth, and the like can refer to elements associated with elements having matching ordinal numbers. For example, a first light bulb can be associated with a first light socket, a second light bulb can be associated with a second light socket, and so on. However, the use of matching ordinal numbers should not be considered limiting on the associations required by the present disclosure.

FIG. 1 is a perspective view of a window frame assembly 100 comprising a window frame 102 and a shear plate 104. In the current aspect, the window frame assembly 100 can be a hinged glass door. In other aspects, the window frame assembly 100 can any other suitable type of door, a window, or the like. As shown in the current aspect, the window frame 102 can comprise a sill 106 (which can be a bottom portion of the frame 102), stiles 108 (which can be vertical portions of the frame 102), and a head (which can be a top of the frame 102, not shown). Each stile 108 can comprise two frame members, such as, for example, an exterior frame member 112 and an interior frame member 114. The exterior frame member 112 and the interior frame member 114 can sandwich and seal a glass pane between an inner portion 116 of the frame members 112,114. In other aspects, the exterior and interior frame members 112,114 can sandwich multiple panes of glass, such as, for example and without limitation, two panes of glass with glazing therebetween. The two panes of glass with glazing therebetween can define a dual pane glass window 118, as shown. In other aspects, the frame 102 may not support glass panes, and instead can be configured to support, for example, a screen, or any other structure that may benefit from the greater structural stability provided by the frame 102.

In example aspects, a thermal break 120 can be placed between the exterior and interior frame members 112,114 at outer portions 126 of the frame members 112,114. The thermal break 120 can be, for example, a plate or strut configured to extend between the frame members 112,114. In the current aspect, the thermal break 120 and shear plate 104 are shown between the exterior and interior frame members 112,114 of the stile 108, but in other aspects, the thermal break 120 and shear plate 104 can be part of the head or sill 106 of the frame 102, alternatively or as well. According to example aspects, a thermal break 120 can be formed from a thermally insulating material such as plastic, and can define isolated air channels 222 (shown in FIG. 2) therethrough that can further prevent thermal conduction through the thermal break 120. A recess 340 (shown in FIG. 3) can be defined within the thermal break 120 and the shear plate 104 can be mounted therein.

The thermal break 120 can lie substantially flush with the outer portion 126 of the exterior and interior frame members 112,114, and the shear plate 104 can lie flush with the thermal break 120, such that an outer surface 128 of the window frame assembly 100 can be substantially planar. The shear plate 104 can comprise shear plate holes 130 formed therethrough, and the shear plate holes 130 can be configured to receive fasteners (such as, for example, screws) that can affix the shear plate 104 to the frame members 112,114 of the stile 108. The shear plate holes 130 can define countersinks 132 in some aspects. According to example aspects, the shear plate 104 can extend substantially from a bottom of the frame 102 to a top of the frame 102. In other aspects, multiple shear plates 104 can be placed along the thermal break 120 at intervals—for example, a first shear plate 104 can be oriented proximate to the sill 106 and a second shear plate can be oriented proximate to the head. In other aspects, the shear plates 104 can be oriented in any other desired pattern or at any other desired location, such that the multiple shear plates 104 can extend substantially from the top to the bottom of the frame 102. In particular, shear plates 104 placed near corners 134 of the frame 100 can impart structural stability to the window frame assembly 100 and thus can be desirable in some aspects.

In example aspects, such as the aspect depicted herein, the shear plate holes 130 can be configured in pairs 136, wherein one of the shear plate holes 130*a* of each pair 136 can be configured to receive a fastener for fastening the shear plate 104 to the exterior frame member 112, and the other shear plate hole 130*b* of the pair 136 can be configured to configured to receive a fastener for fastening the shear plate 104 to the interior frame member 114. Each of the exterior and interior frame members 112,114 can define flange holes 338 therethrough, such as flange holes 338*a,b*, (shown in FIG. 3) that can be configured to align with the corresponding shear plate holes 130*a,b*, respectively, of the shear plate 104. In the current aspect, the shear plate 104 can define fifteen pairs 136 of shear plate holes 130*a,b*, but any number of shear plate holes 130 can be present in other aspects as desired.

According to example aspects, various external hardware, such as a hinge assembly 140, can be placed over and mounted to the shear plate 104, as shown. The hardware can define holes 141 that can be aligned with some or all of the shear plate holes 130 of the shear plate 104, such that a single fastener (e.g., a screw) can fasten the external hardware to the shear plate 104 and to one of the exterior and interior frame members 112,114 of the stile 108.

Figure 2:
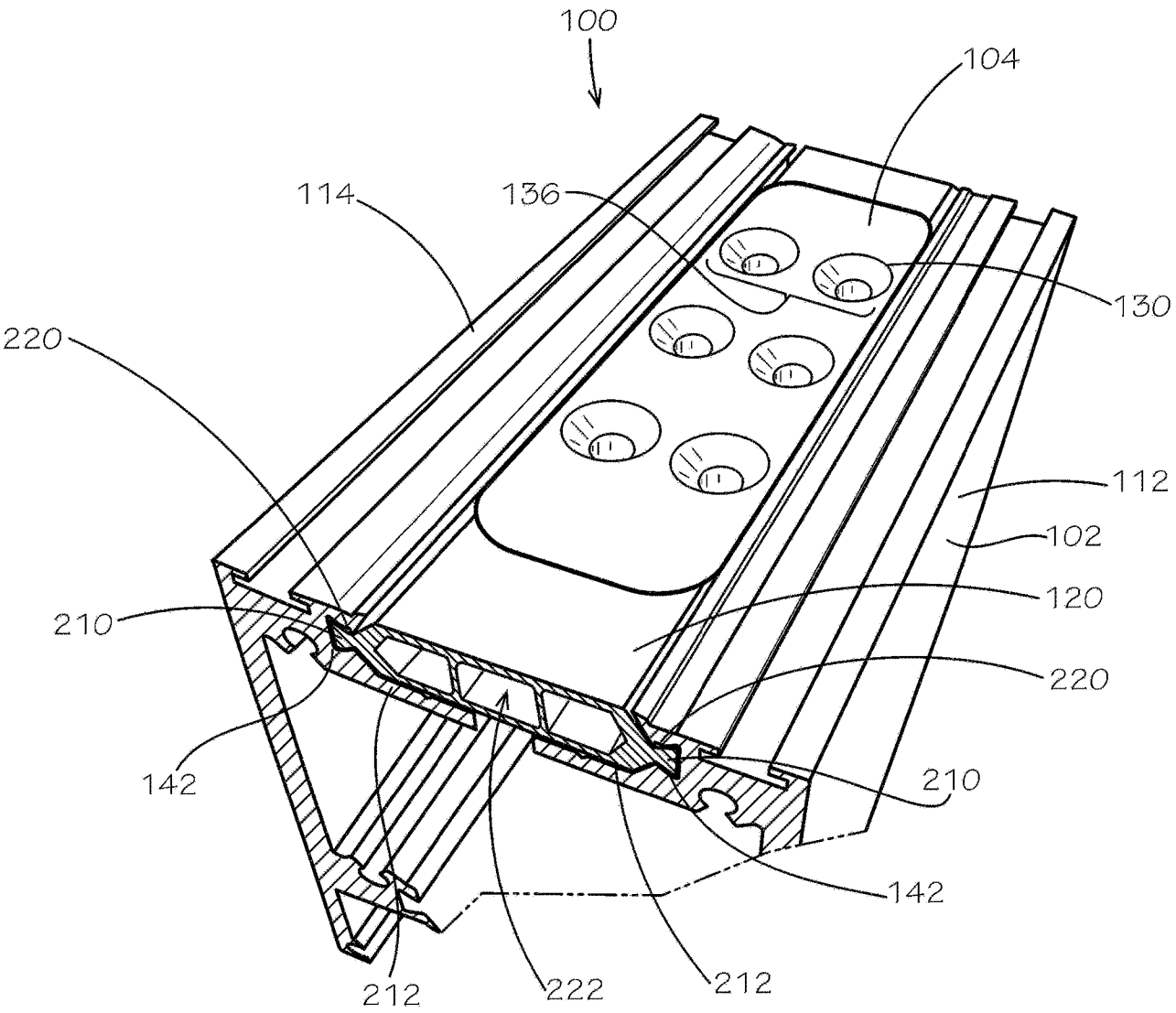
FIG. 2 is a perspective view of the window frame assembly comprising the shear plate in accordance with another aspect of the present disclosure.

FIG. 2 is a perspective detail view of the window frame assembly 100 comprising another aspect of the shear plate 104 with only three pairs 136 of shear plate holes 130. The thermal break 120 can comprise a pair of opposing ribs 210, wherein each of the ribs 210 is configured to slide lengthwise into a channel 142 formed in one of the exterior and interior frame members 112,114. This engagement of the ribs 210 with the channels 142 can aid in preventing the exterior and interior frame members 112,114 from being separated from each other when pulled in laterally opposite directions.

According to example aspects, the shear plate 104 can be configured to engage the recess 340 (shown in FIG. 3) formed in the thermal break 120, and the recess 340 can be sized to receive the shear plate 104 mounted therein, which can, in some aspects, fit snugly within the recess 340 without any gaps, so as to tightly engage the thermal break 120. Furthermore, as shown, the frame members 112,114 can each comprise a flange 212 extending lengthwise and configured to lay under and abut a portion of the thermal break 120 (relative to the orientation shown in FIG. 2).

The shear plate 104 can be constructed from various materials, such as, for example, metal or plastic, and in some aspects, the shear plate 104 can be thermally conductive or insulating. Other aspects of the shear plate 104 can be formed from any other suitable material or combination of materials known in the art. Example aspects of the shear plate 104 can have various alternative internal structures which can affect its rigidity and/or thermal conductivity, among other properties. In some aspects, the shear plate 104 can comprise a rigid and strong metal material, such as solid aluminum or steel, and in other aspects, the shear plate 104 can comprise a rigid plastic that can be stronger than the material forming the thermal break 120 but can still be resistant to thermal conductivity.

Figure 3:
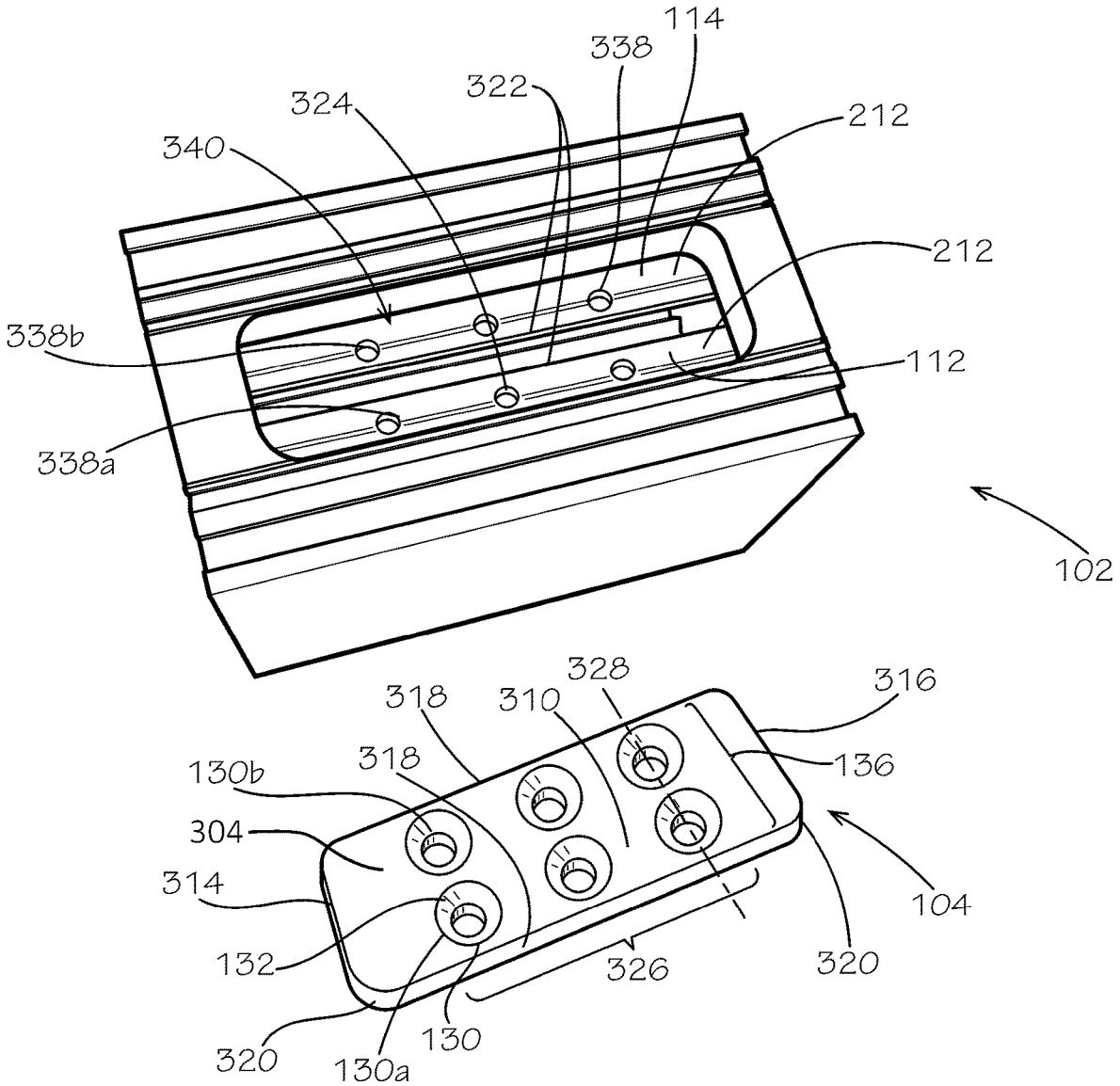
FIG. 3 is a perspective view of the shear plate of FIG. 2 disengaged from the window frame assembly of FIG. 2.

FIG. 3 is a perspective view of the shear plate 104 removed from the window frame 102. The shear plate 104 can comprise a shear plate body 304. The shear plate body 304 can define an outer shear plate surface 310 and an inner shear plate surface (not shown) opposite the outer shear plate surface 310. The shear plate holes 130 can be formed through the shear plate body 304 and can define the countersinks 132 at the outer shear plate surface 310 of the shear plate body 304, and the shear plate holes 130 can extend fully from outer shear plate surface 310 to the inner shear plate surface. The shear plate 104 can further define a first end 314, a second end 316 opposite the first end 314, and a pair of lateral sides 318 that can extend lengthwise between the first and second ends 314,316. The two lateral sides 318 can be configured to run lengthwise along the exterior and interior frame members 112,114 when the shear plate 104 is mounted within the recess 340 of the thermal break 120. In example aspects, the first and second ends 314,316 and the lateral sides 318 of the shear plate 104 can be substantially planar, and they can meet at substantially rounded corners 320 in some aspects, as shown.

The fasteners configured to extend through the shear plate holes 130 of the shear plate 104 can engage the window frame 102 to attach the shear plate 104 to the window frame 102. According to example aspects, the flanges 212 of the frame members 112,114 can define the flange holes 338*a,b* configured to align with the shear plate holes 130*a,b*, respectively, of the shear plate 104. The fasteners can engage the shear plate holes 130*a,b* and the corresponding flange holes 338*a,b* to secure the shear plate 104 to the exterior and interior frame members 112,114. In other aspects, such as the aspect of FIGS. 1 and 4, the flanges 212 may not define the flange holes 338 before the shear plate 104 is inserted into the recess 340 of the thermal break 120. In such an aspects, fasteners such as self-drilling screws (not shown) can be driven through the shear plate 104 and into the flanges 212 to form the flange holes 338 in the flanges 212 proximate to the inner shear plate surface of the shear plate 104. In example aspects, the flanges 212 can be configured and spaced such that its flange holes 338 can be defined at a predetermined distance from inward edges 322 of the corresponding flanges 212. For example, a distance from the inward edge 322 of each flange 212 to an edge 324 of each corresponding flange hole 338 can be greater than, for example, a quarter (or a half) of a diameter of the flange hole 338 to maintain the strength of the connection between the shear plate 104 and the frame members 112,114. Other predetermined distances can be present in other aspects as desired. As such, the window frame assembly 100 can maintain its strength when the shear plate 104 is assembled with the window frame 102. The flanges 212 of each frame member 112,114 can also be configured not to touch one another in the assembled configuration, though in other aspects, the flanges 212 may touch.

In the current aspect, the shear plate 104 can define six shear plate holes 130. Two rows 326 of shear plate holes 130 (with three shear plate holes 130 each) can run generally along the two lateral sides 318 of the shear plate 104. That is to say, a first one of the rows 326 can be disposed proximate a first one of the lateral sides 318 and a second one of the rows 326 can be disposed proximate a second one of the lateral sides 318. The six shear plate holes 130 can also be grouped into three pairs 136 of two shear plate holes 130*a,b*, wherein each pair 136 can be configured such that a line 328 running through a center of each pair 136 can be substantially parallel to the first and second ends 314,316. In other aspects, the line 328 extending across each pair 136 can be angled with respect to the first and second ends 314,316. In yet other aspects, the total number of shear plate holes 130 may vary, and/or each row 326 can have different numbers of shear plate holes 130 as desired.

In some aspects, a thin plate (not shown) can be placed between the shear plate 104 and the flanges 212. The thin plate can comprise, for example and without limitation, a plastic material or other material with a low thermal conductivity and can thereby prevent thermal conduction between the flanges 212 and the shear plate 104.

Figure 4:
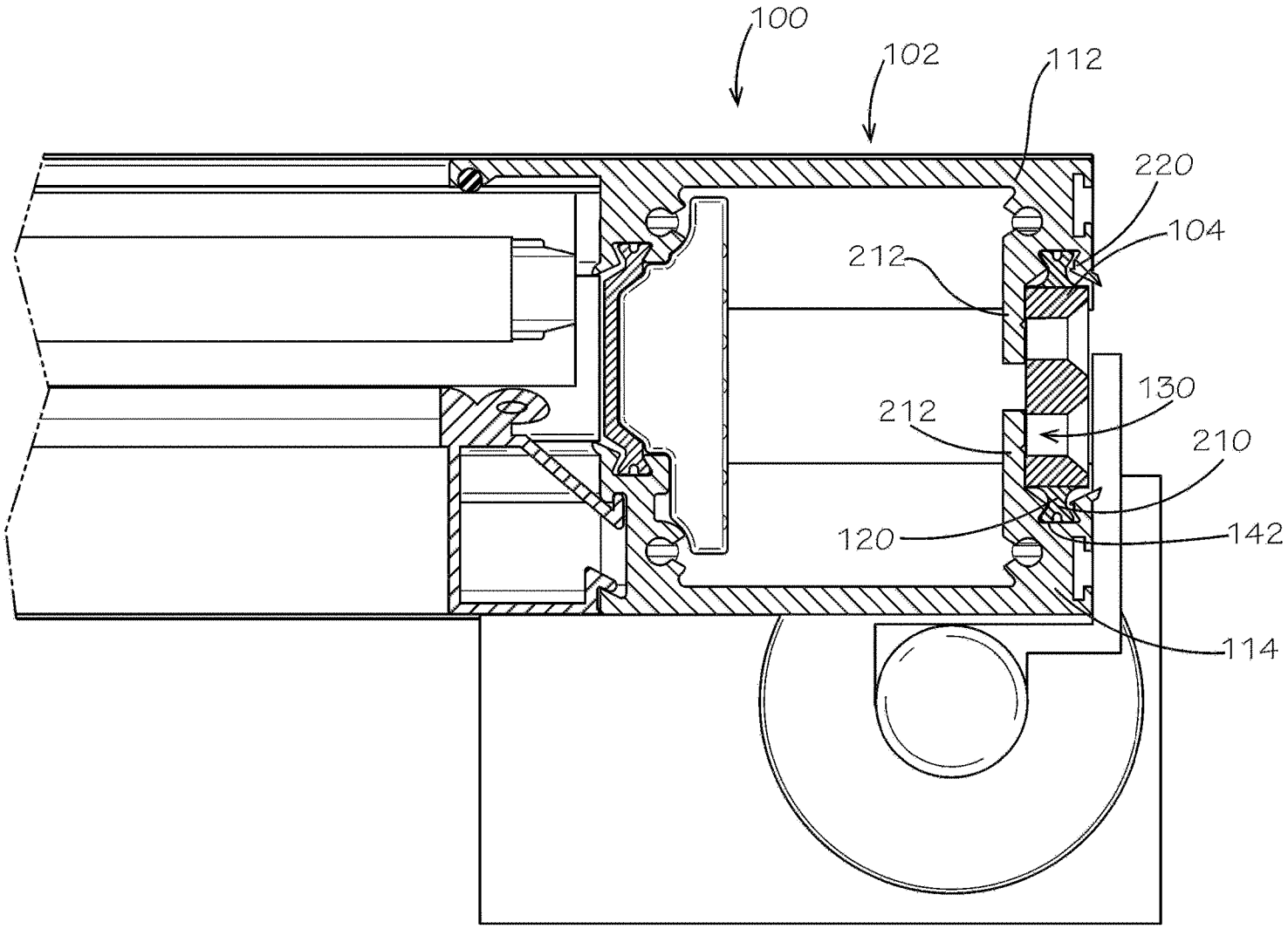
FIG. 4 is a detail cross-section view of the window frame of FIG. 1 taken along line 4-4 in FIG. 1.

FIG. 4 is a detail cross-section view of the window frame assembly 100 of FIG. 1 taken along line 4-4 in FIG. 1. As shown, the shear plate 104 can be received within the recess 340 (shown in FIG. 3) of the thermal break 120. Further, the ribs 210 of the thermal break 120 can engage the channels 142 of the exterior and interior frame members 112,114. In the aspect of FIG. 4, the flanges 212 lack the pre-drilled flange holes 338 (shown in FIG. 3) to engage the screws or other fasteners extending through the shear plate holes 130 in the shear plate 104, and the screws can be self-drilling to form the flange holes 338 through the flanges 212 after being inserted through the shear plate 104.

The process of assembling the window frame assembly 100 comprising the frame 102 and the shear plate 104 may comprise the steps of placing the shear plate 104 into the recess 340 of the thermal break 120, placing the thermal break 120 between the exterior and interior frame members 112,114, and fastening the shear plate 104 to the exterior and interior frame members 112,114. Placing the thermal break 120 between the exterior and interior frame members 112, 114 can comprise inserting the ribs 210 of the thermal break 120 into the corresponding channels 142 of the frame members 112,114 and then pressing or rolling a roller over the outer surface 128 (shown in FIG. 1) of the window frame assembly 100 such that the channels 142 can narrow in size by bending hammers 220 defined in each frame member 112,114 to engage and trap the hammers 220 with the ribs 210. The thermal break 120 can be thereby prevented from lengthwise movement with respect to the frame members 112,114 by friction between the ribs 210 and the channels 142. Despite the aforementioned friction forces, strong forces—such as from stormy winds—may be capable of displacing the thermal break 120, lengthwise or even laterally. The fastening of the shear plate 104 to the exterior and interior frame members 112,114 can provide additional strength to the window frame assembly 100 and prevent displacement of the thermal break 120 therefrom.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A window frame assembly comprising:

a window frame defining a sidewall and a flange extending from and oriented substantially perpendicular to the sidewall, the flange defining a flange hole;

a thermal break engaging the window frame, the thermal break defining an outer surface, an inner surface opposite the outer surface, and a recess extending through the thermal break from the outer surface to the inner surface;

a shear plate mounted in the recess; and a fastener coupling the shear plate to the window frame, the fastener engaging the flange hole of the flange.

2. The window frame assembly of claim 1, wherein the window frame comprises an exterior frame member and an interior frame member.

3. The window frame assembly of claim 2, wherein the thermal break extends between the exterior frame member and the interior frame member.

4. The window frame assembly of claim 3, wherein:

the thermal break defines a first rib and a second rib;

the first rib engages a first channel formed in the exterior frame member; and the second rib engages a second channel formed in the interior frame member.

5. The window frame assembly of claim 4, wherein the exterior frame member defines a first hammer bent into the first channel to engage the first rib and the interior frame member defines a second hammer bent into the second channel to engage the second rib.

6. The window frame assembly of claim 2, wherein at least one glass pane is sandwiched between the exterior frame member and interior frame member.

7. The window frame assembly of claim 1, wherein:

the shear plate defines a shear plate hole; and the fastener extends through the shear plate hole.

8. The window frame assembly of claim 7, wherein:

the window frame comprises an exterior frame member and an interior frame member;

the flange is a first flange extending from the exterior frame member;

a second flange extends from the interior frame member and abuts the inner surface of the thermal break;

the fastener is a first fastener extending through a first shear plate hole of the shear plate and engaging the first flange to attach the shear plate to the exterior frame member; and a second fastener extends through a second shear plate hole of the shear plate and engages the second flange to attach the shear plate to the interior frame member.

9. The window frame assembly of claim 1, further comprising a hinge assembly mounted to the shear plate.

10. A method of insulating a window frame assembly comprising:

providing a window frame comprising an exterior frame member and an interior frame member, each of the exterior and interior frame members defining a sidewall and a flange extending from and oriented substantially perpendicular to the sidewall, each of the flanges defining a flange hole;

mounting a shear plate in a recess of a thermal break, the recess extending through the thermal break from an outer surface of the thermal break to an inner surface of the thermal break;

engaging the thermal break with the exterior frame member and the interior frame member; and fastening the shear plate to the exterior frame member and the interior frame member, wherein fastening the shear plate to the exterior frame member and the interior frame member comprises engaging a fastener with each of the flange holes.

11. The method of claim 10, wherein engaging the thermal break with the exterior frame member and the interior frame member comprises engaging a first rib of the thermal break with a first channel of the exterior frame member and engaging a second rib of the thermal break with a second channel of the interior frame member.

12. The method of claim 11, further comprising:

engaging a first hammer of the exterior frame member with the first rib; and engaging a second hammer of the interior frame member with the second rib.

13. The method of claim 12, wherein engaging a first hammer of the exterior frame member with the first rib and engaging a second hammer of the interior frame member with the second rib comprises pressing a roller into an outer surface of the window frame assembly to bend the first hammer into the first channel and to bend the second hammer into the second channel.

14. The method of claim 10, wherein fastening the shear plate to the exterior frame member and the interior frame member comprises:

inserting a first fastener through a first shear plate hole of the shear plate and engaging the first fastener with the exterior frame member; and inserting a second fastener through a second shear plate hole of the shear plate and engaging the second fastener with the interior frame member.

15. The window frame assembly of claim 1, wherein the flange of the mounting frame abuts the shear plate.

16. The window frame assembly of claim 1, wherein:

the inner surface of the thermal break is substantially planar;

the flange defines a substantially planar flange surface; and the substantially planar flange surface abuts the substantially planar inner surface of the thermal break.

17. The window frame assembly of claim 7, wherein:

the shear plate comprises a shear plate body defining an outer shear plate surface and an inner shear plate surface; and the shear plate hole extends from the outer shear plate surface to the inner shear plate surface;

each of the shear plate holes defining a frustoconical countersink at the outer shear plate surface.

18. The window frame assembly of claim 17, wherein the frustoconical countersink terminates between the outer and inner shear plate surfaces.

19. The method of claim 10, wherein each of the flanges abuts the shear plate.

* * * * *